United States Patent [19]

Frutin

[11] Patent Number: 4,826,054

[45] Date of Patent: May 2, 1989

[54] AEROSOL VALVE ACTUATOR

[75] Inventor: Bernard D. Frutin, Stewarton, Great Britain

[73] Assignee: Rocep Lusol Holdings Limited, Glasgow, United Kingdom

[21] Appl. No.: 46,877

[22] PCT Filed: Oct. 8, 1986

[86] PCT No.: PCT/GB86/00608

§ 371 Date: Mar. 24, 1987

§ 102(e) Date: Mar. 24, 1987

[87] PCT Pub. No.: WO87/02335

PCT Pub. Date: Apr. 23, 1987

[30] Foreign Application Priority Data

Oct. 16, 1985 [GB] United Kingdom ..... 8525520
Aug. 26, 1986 [GB] United Kingdom ..... 8620641

[51] Int. Cl.[4] ..... B65D 83/00

[52] U.S. Cl. ..... 222/402.11; 222/402.14; 222/402.15; 222/509

[58] Field of Search ..... 222/402.1, 402.11, 402.14, 222/402.15, 509, 153

[56] References Cited

U.S. PATENT DOCUMENTS

| | | | |
|---|---|---|---|
| 2,558,272 | 6/1951 | Rubinstein et al. | 222/402.15 |
| 3,305,144 | 2/1967 | Beres et al. | 222/402.14 X |
| 3,987,942 | 10/1976 | Morane et al. | 222/402.15 |
| 4,669,639 | 6/1987 | Klarenbach et al. | 222/402.15 X |

FOREIGN PATENT DOCUMENTS

| | | | |
|---|---|---|---|
| 836915 | 3/1970 | Canada | 222/402.15 |
| 815610 | 7/1959 | United Kingdom | 222/402.15 |
| 833056 | 4/1960 | United Kingdom | 222/402.15 |

*Primary Examiner*—Joseph J. Rolla
*Assistant Examiner*—Gregory L. Huson
*Attorney, Agent, or Firm*—Mason, Fenwick & Lawrence

[57] ABSTRACT

The valve of an aerosol can is actuated by a lever having a handle portion and an intermediate portion bearing on a lock member. The lever is pivotably mounted in a clip. The lock member is in screw-threaded engagement with the valve for movement the realong between closed and open positions. The lock member can be placed in any intermediate position to set a desired flow rate through the valve when the lever is depressed by the user.

7 Claims, 5 Drawing Sheets

26
18
28
36
42
16
38
46
34
20
44
24
32
30
14
48
12
48b
22
40
10

AEROSOL VALVE ACTUATOR

This invention relates to an actuator arrangement for the valve of an aerosol pack. The term "aerosol pack" is used herein to denote a container in which is a material to be dispensed ("the product") by means of a propellant, either of a true aerosol type in which the product is in admixture with or in solution in the propellant, or of the type where these two are separated by a membrane, diaphragm or piston. The invention is particularly but not exclusively applicable to aerosol packs for dispensing viscous or semi-solid material such as mastic or silicone rubber.

Such products require a high propellant pressure to dispense them satisfactorily. This in turn means that a relatively high pressure must be exerted by the user on the valve to open it. It is known to provide the valve with diametrically extending wings to allow the user to engage a finger on either side. However, this arrangement is clumsy to use, very often requiring the bottom of the can to be held in the other hand, and is tiring in use.

It is therefore an object of the present invention to provide an improved arrangement for actuating the valve of an aerosol pack, which overcomes or mitigates the above disadvantages.

Accordingly, the invention resides in an aerosol pack (as defined above) comprising a body for containing the product and propellant; an outlet valve member slidably movable in the body between closed and open positions; and an actuator having one end fixed with respect to the body, another end forming a handle, and an intermediate portion engaged with the valve member.

An embodiment of the invention will now be described, by way of example with reference to the accompanying drawings, in which.

Figure 1:
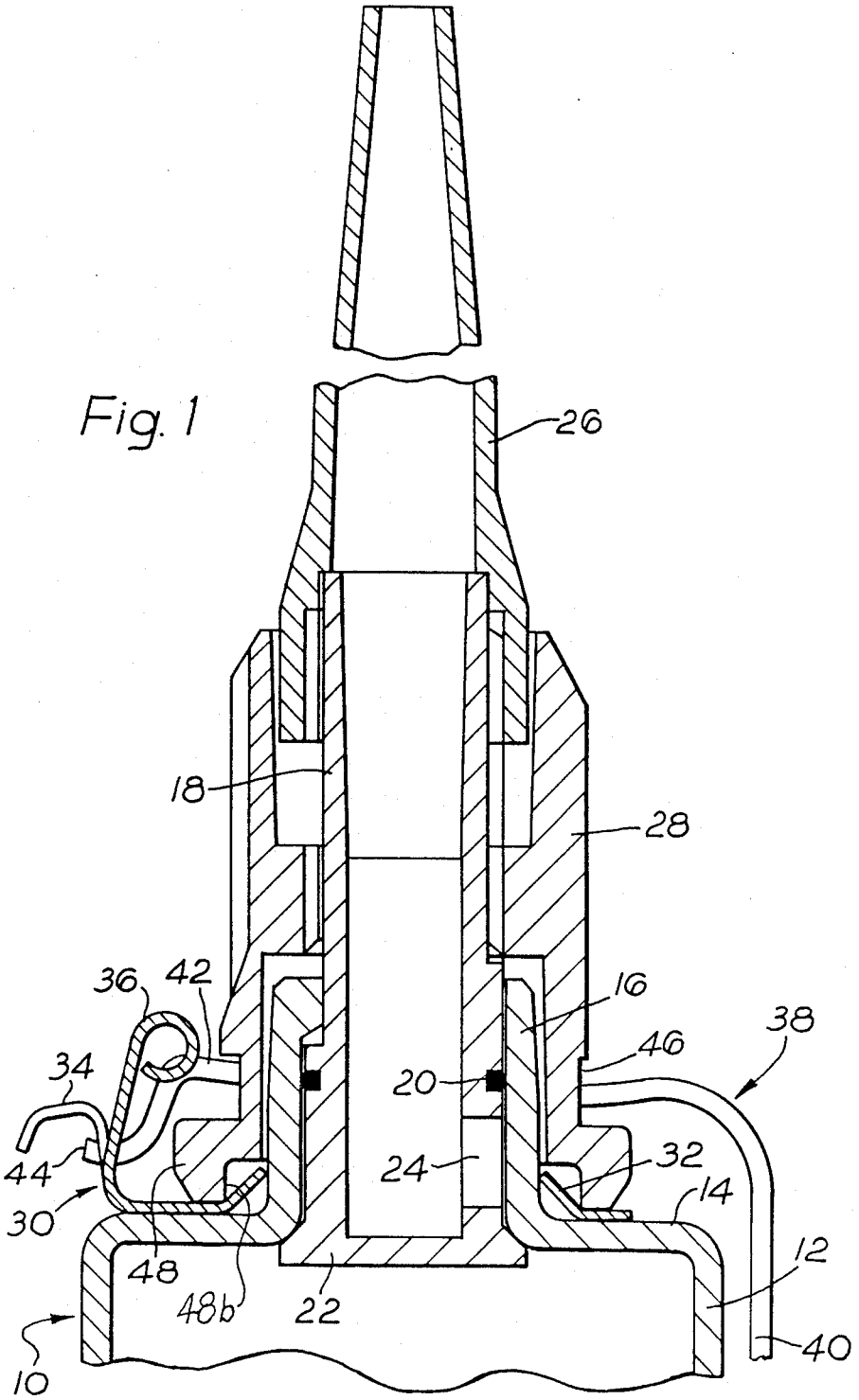
FIG. 1 is a longitudinal cross-section through the upper part of an aerosol pack in accordance with the invention.

Referring to FIG. 1, the pack comprises a can body 10 having a cylindrical side wall 12 and integral top 14 formed from aluminium by deep drawing. The central part of the top 14 is formed as a boss 16 of generally cylindrical form. A valve member 18 is slidably seated in the boss 16 and forms a seal therewith by means of O-ring 20. The valve member 18 has a flanged base 22 which is normally seated by the internal propellant pressure against the top 14 to close the pack. Downward movement of the valve member 18 against the internal pressure allows the product to exit via apertures one of which is seen at 24. A tapered nozzle 26 is threadedly engaged with the upper end of the valve member 18.

A lock member 28 is in threaded engagement with the exterior of the valve member 18. In the position shown in FIG. 1, the lock member 28 engages the top 14 and prevents actuation of the valve. To dispense the product, the lock member is screwed up the valve member 18, as will be discussed in more detail below, and the valve member can then be depressed to dispense the product.

Figure 4:
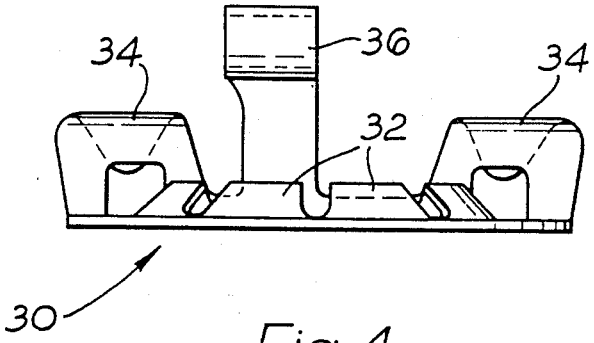
FIG. 4 is a side view of a clip of FIG. 1.
Figure 5:
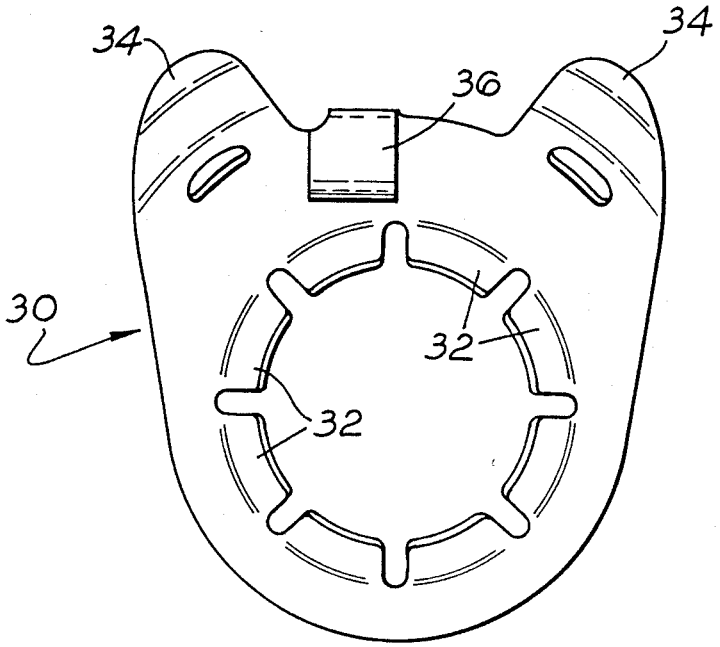
FIG. 5 is a plan view of the clip of FIG. 4.

A clip 30 formed from spring steel is positioned between the lock member 28 and the can top 14. The clip 30 (see also FIGS. 4 and 5) comprises teeth 32 engaging the boss 16, a pair of bent-over fulcrum portions 34, and an upwardly-extending stop portion 36.

An actuator 38 (see also FIGS. 6 and 8) is provided in the form of a wire shaped to provide a handle portion 40, a pair of curved cam portions 42, and a pair of free ends 44. The ends 44 are engaged under the fulcrum portions 34 of the clip 30 and the cam portions 42 lie within a groove 46 on the lock member to bear on a flange 48 thereof. When the lock member 28 is engaged with the can top 14 as in FIG. 1, the handle portion lies alongside the can side wall 12.

Figure 2:
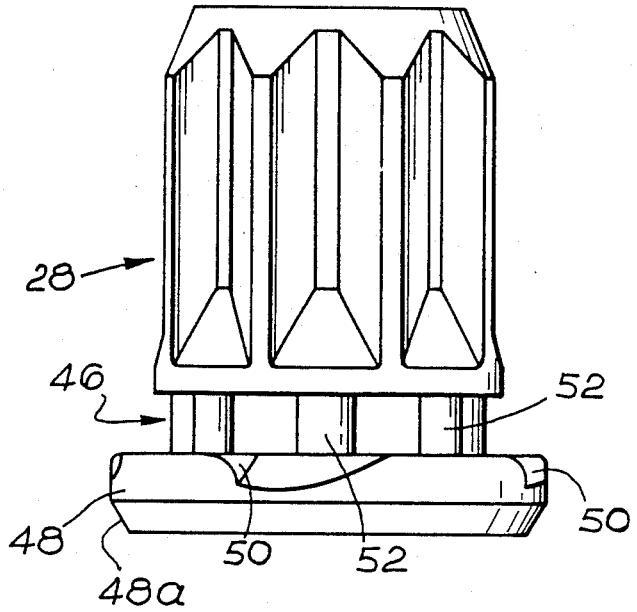
FIG. 2 is a side view of a lock member of FIG. 1.
Figure 3:
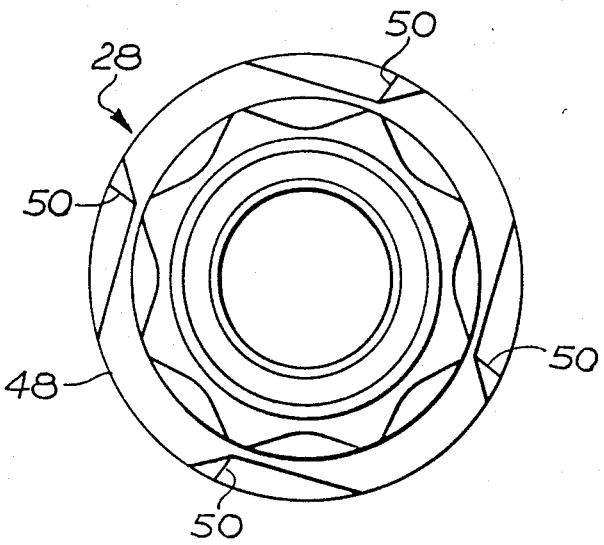
FIG. 3 is a plan view of the lock member of FIG. 2.

To dispense product, the lock member is screwed upwardly by an amount depending on the rate of discharge desired. A maximum limit to this movement is set by the stop portion 36 of the clip 30 engaging one of a number of shoulders 50 (see FIG. 2 and 3) formed around the circumference of the lock member 28. The arrangement is such that the maximum travel of the valve member retains the O-ring 20 within the boss 16. The groove 46 in lock member 28 is provided with protrusions 52, and the actuator 38 is dimensioned such that the cam portions 42 exert a gripping force on the lock member 28; this produces a "click" effect which gives the user an indication of the degree of rotation achieved.

Figure 6:
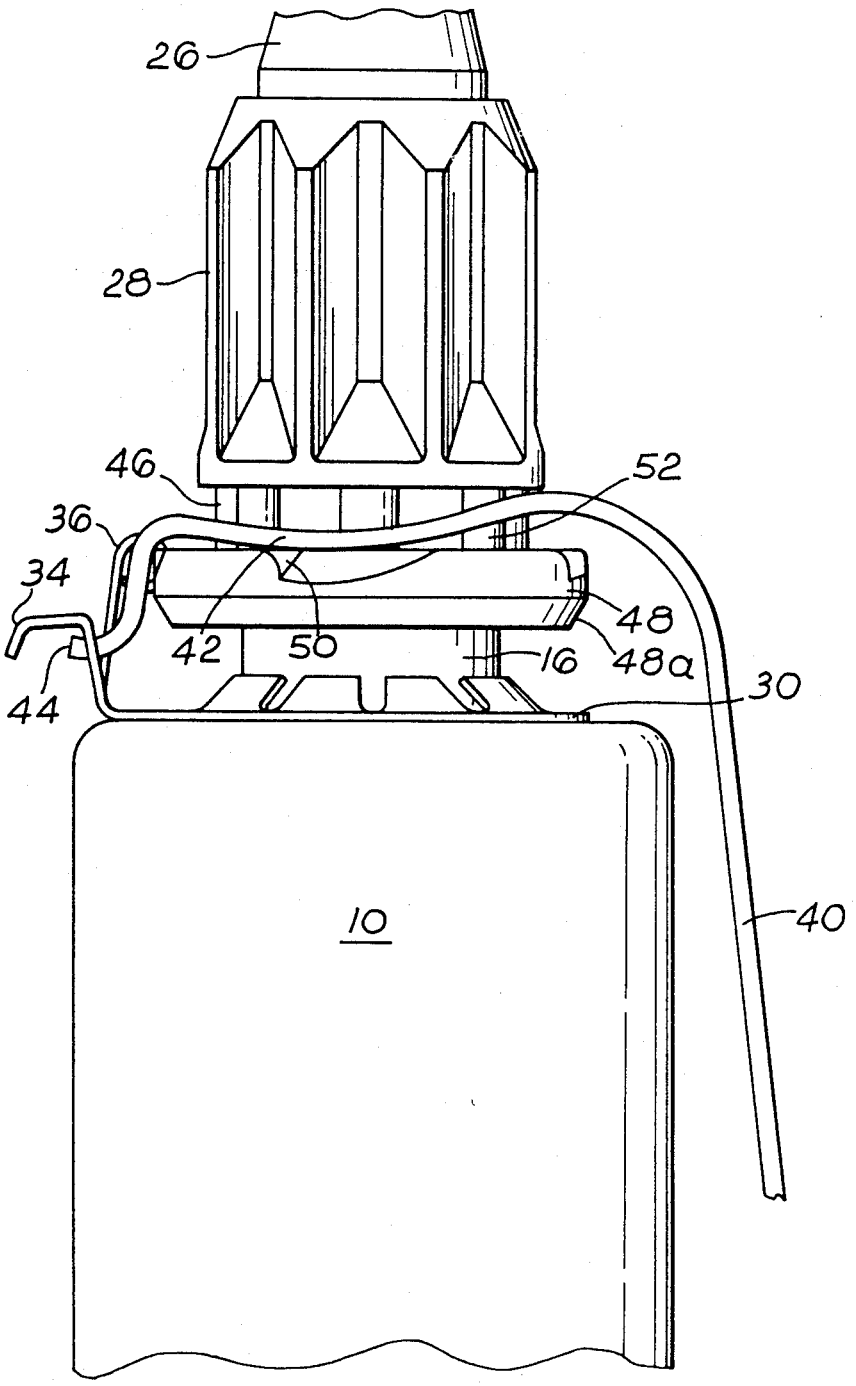
FIG. 6 is a side view corresponding to FIG. 1, but showing the lock member in unlocked position.

Rotation of the lock member 28 and its corresponding movement away from the can top 14 causes the handle portion 40 to swing out from the side wall 12, as seen in FIG. 6. The pack may then be held in one hand with the fingers on the handle portion 40. Tightening the grip moves the handle portion 40 inwards and opens the valve member via the action of the cam portions 42 on the flange 48. The actuator 38 acts as a lever giving a mechanical advantage and thus makes operation of the pack easier and less fatiguing.

The cam portions 42 are preferably shaped such that the point of engagement with the flange 48 is aligned with the longitudinal axis of the can when the valve is open. This gives optimum mechanical advantage and minimises any tendency of the valve to stick in its travel.

It is preferred to assemble the parts by positioning the clip 30 on the boss 16 and then forcing the clip downward by screwing the lock member 28 home. To assist in this, the upper part of the external surface of the boss 16 is tapered, as seen in FIG. 1, which permits the clip to be placed at an angle on the boss 16. The under surface of the flange 48 is cut away at 48b (FIG. 1) to provide an annular surface bearing on the clip 30 while clearing the teeth 32; this allows the stop member 28 to be screwed down to force the clip home, as described above. The stop portion 36 in the embodiment shown is formed such that it will snap over the flange 48 during this operation. It is also possible in a modification (not shown) to use a stop portion without a rolled-over top: by using the angled placement of clip 30 referred to above, the stop portion is rotated to a position above flange 48 without engaging it. In this case the chamfer 48a on the flange shown can be dispensed with.

Preferred applications of the pack are in the dispensing of silicone compounds and other curable compounds, for which polypropylene is the preferred material for the valve member, as the product will not cure to it. It has been found that with a polypropylene valve member, a lock member of the same material will not rotate freely, and high-density polythylene is a suitable material for the lock member.

Figure 7:
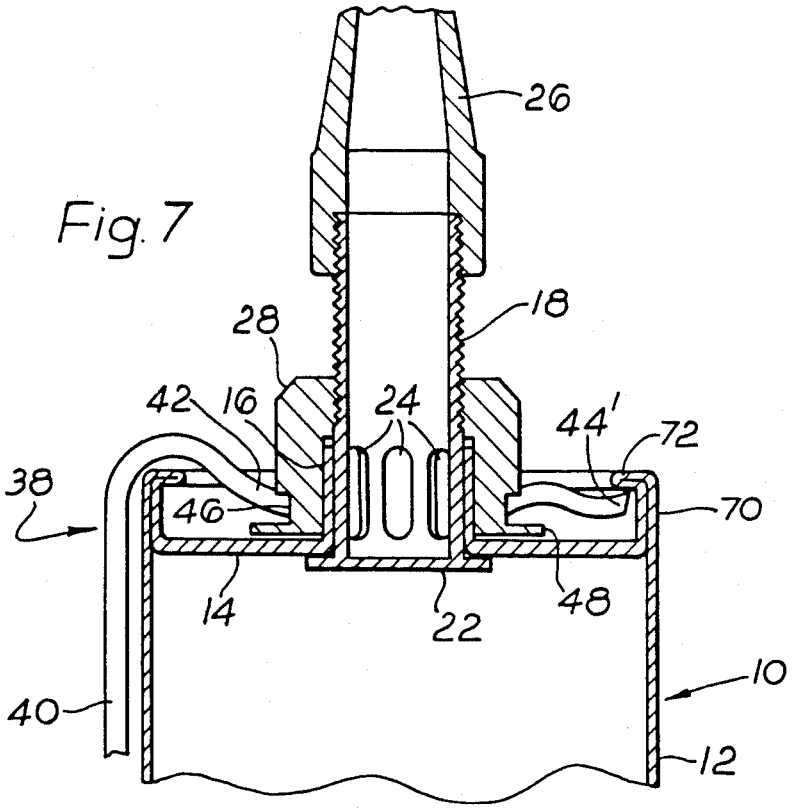
FIG. 7 is a cross-sectional side view illustrating a modified form of the invention and FIG. 8 is a perspective view of an actuator for use in the above embodiments.

FIG. 7 shows a modified form of embodiment in which the clip 30 is omitted. The junction between the side wall 12 and top 14 of the cam is formed to provide an upstanding rim 70 and inturned flange 72, and the actuator 38 has its free ends formed as hooked portions 44' hooked under the flange 72.

Figure 8:
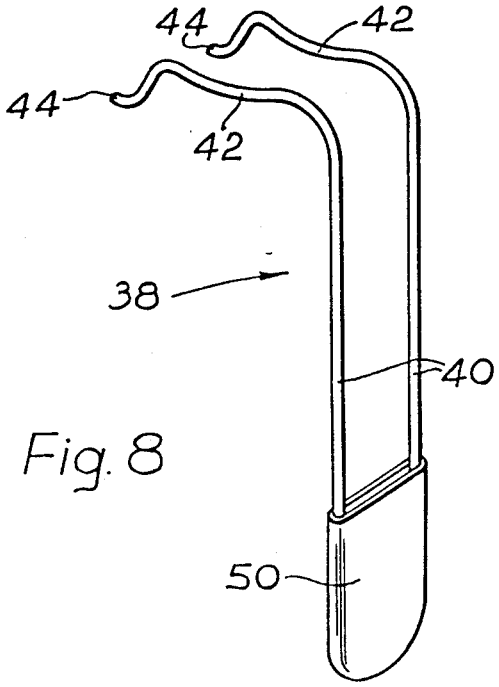

The use of shaped wire for the actuator is preferred for ease of assembly. The handle portion may be provided with a soft plastics cover or sleeve 50 (FIG. 8). However, actuators of other materials and shapes may be used within the scope of the present invention.

I claim:

1. A pressurized pack for dispensing viscous material, semi-solid material, and the like comprising a body for containing a product and a propellant; an outlet valve member slidably movable in the body between closed and open positions; and an actuator having one end fixed with respect to the body, another end forming a handle, and an intermediate portion engaged with the valve member; the actuator engaging with the valve member via a lock member which is axially movable on the valve member between locked and unlocked positions which respectively prevent and permit movement of the valve member in the body; the actuator being generally L-shaped with the handle lying adjacent a side wall of the body when the lock member is in said locked position but being angled to said side wall when the lock member is in said unlocked position, the lock member being positionable selectively at any position between said locked and unlocked positions to set the maximum opening of the valve member and thus to select the flow rate of the product, the valve member and the lock member being formed with cooperating screw threads, and a stop provided to limit the maximum travel of the lock member and thus the maximum valve opening travel, said stop comprising one or more shoulders on the lock member cooperating with a tab upstanding from a clip positioned under the lock member.

2. The pack of claim 1, in which the clip is also formed to provide pivot means for said one end of the actuator.

3. The pack of claim 1, in which the clip is formed with spring teeth engaging a neck formed in the top of the body, the valve member being slidable within the neck.

4. The pack of claim 3 in which at least part of the outer surface of the neck is tapered to permit the clip to be seated thereon at an angle during assembly.

5. The pack of claim 1, in which the actuator comprises spaced limbs the intermediate portions of which bear on a flange formed on the lock member.

6. The pack of claim 5 in which said intermediate portions are curved to form a cam such that the point of contact of the cam is aligned with the central axis of the valve when the valve is fully open.

7. The pack of claim 5, in which said limbs resiliently grip an area of the lock member, and the lock member is formed with protrusions in said area to provide a tactile indication of the degree of opening.

* * * * *